US006379505B1

(12) United States Patent
Wiljan et al.

(10) Patent No.: US 6,379,505 B1
(45) Date of Patent: Apr. 30, 2002

(54) PULPER

(75) Inventors: Harry Wiljan; Roland Carra, both of München (DE)

(73) Assignee: REA Gesellschaft fur Recycling von Energie und Abfall mbH (DE)

( * ) Notice: Subject to any disclaimer, the term of this patent is extended or adjusted under 35 U.S.C. 154(b) by 0 days.

(21) Appl. No.: 09/701,475

(22) PCT Filed: Jun. 2, 1999

(86) PCT No.: PCT/EP99/03852

§ 371 Date: Nov. 29, 2000

§ 102(e) Date: Nov. 29, 2000

(87) PCT Pub. No.: WO99/63148

PCT Pub. Date: Dec. 9, 1999

(30) Foreign Application Priority Data

Jun. 3, 1998 (DE) ..... 198 24 806

(51) Int. Cl.[7] ..... D21C 7/00; B02C 13/00

(52) U.S. Cl. ..... 162/261; 162/4; 162/55; 241/69; 241/71; 241/72; 241/73

(58) Field of Search ..... 162/55, 57, 251, 162/261, 4; 241/46.17, 69, 73, 70, 71, 72, 89.3

(56) References Cited

U.S. PATENT DOCUMENTS

| | | | | | |
|---|---|---|---|---|---|
| 1,690,496 | A | * | 11/1928 | Marcy | |
| 1,753,355 | A | * | 4/1930 | Stine | |
| 2,661,666 | A | | 12/1953 | Knoll | 92/23 |
| 3,525,477 | A | * | 8/1970 | Kobayashi | |
| 3,656,528 | A | * | 4/1972 | Mencacci | 146/174 |
| 3,942,728 | A | * | 3/1976 | Christ et al. | 241/46.17 |
| 3,945,576 | A | * | 3/1976 | Kahmann | 241/46.17 |
| 3,986,676 | A | * | 10/1976 | Husmann | 241/51 |
| 3,989,197 | A | * | 11/1976 | Neitzel | 241/43 |
| 4,089,477 | A | * | 5/1978 | Tiggesbaumker et al. | 241/78 |
| 4,135,671 | A | * | 1/1979 | Khors | 241/46.04 |
| 4,216,918 | A | * | 8/1980 | Kahmann et al. | 241/46 |
| 4,283,275 | A | * | 8/1981 | Heinbockel et al. | 209/3 |
| 4,387,856 | A | * | 6/1983 | Selder | 241/28 |
| 4,605,173 | A | * | 8/1986 | Edmonds | 241/36 |
| 5,450,868 | A | * | 9/1995 | Young, Jr. | 134/111 |

FOREIGN PATENT DOCUMENTS

| | | | | |
|---|---|---|---|---|
| DE | 964286 | | 5/1957 | |
| DE | 20 61 519 | | 8/1971 | D21B/1/34 |
| DE | 23 48 540 | | 3/1975 | D21B/1/34 |
| DE | AS 26 58 845 | | 6/1978 | D21B/1/34 |
| DE | 195 06 084 | | 8/1996 | B07B/1/46 |
| EP | 0 598 187 | | 5/1994 | D21B/1/34 |
| EP | 0 520 172 | | 12/1995 | C05F/9/00 |
| FR | A-1 374 767 | | 8/1964 | |
| SU | 922212 | * | 4/1982 | D21B/1/34 |

OTHER PUBLICATIONS

International Search Report for PCT/EP99/03852, Oct. 4, 1999.

* cited by examiner

*Primary Examiner*—Peter Chin
*Assistant Examiner*—Carlos Lopez
(74) *Attorney, Agent, or Firm*—Myers Bigel Sibley & Sajovec

(57) ABSTRACT

A pulper device includes a vessel in which an annular flow can be generated. The flow acts upon a liquid-sold mixture located inside the vessel and effects a pulping of the same. The device also comprises a screening device for separating coarse materials from the suspension, whereby the screening device has the shape of a truncated cone. The truncated cone is provided with holes on the lateral surface thereof and can be mounted on the base of the vessel in such a way that the truncated cone points upward with the small circular surface thereof, and the lateral surface lies in an approximately tangential manner to the toroidal flow. The screening device is subdivided into different segments and these segments can be individually mounted from the external side of the vessel.

11 Claims, 1 Drawing Sheet

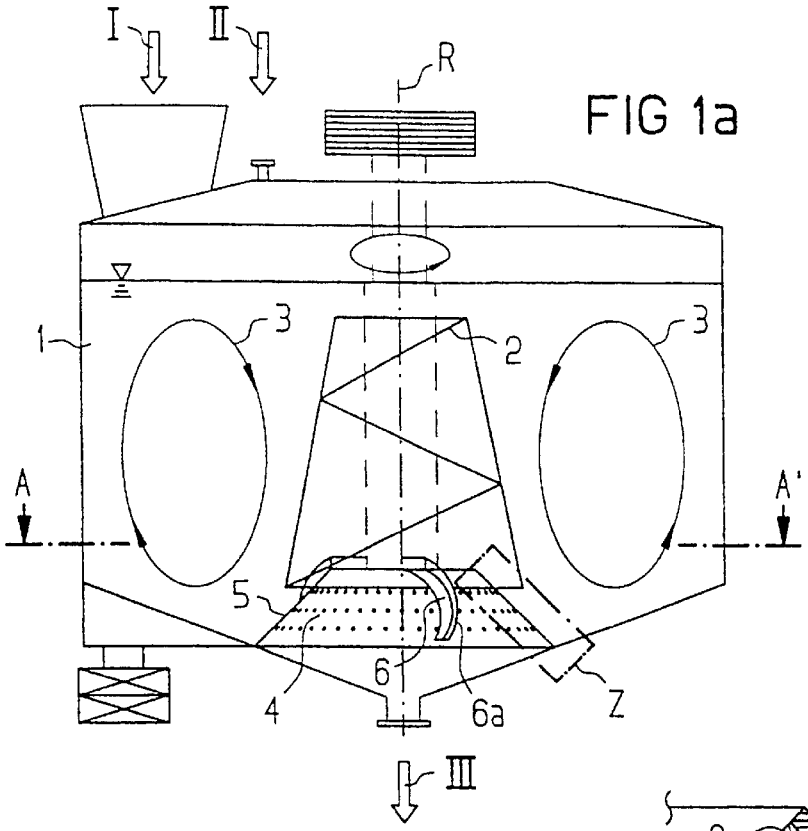
FIG 1a
FIG 1c
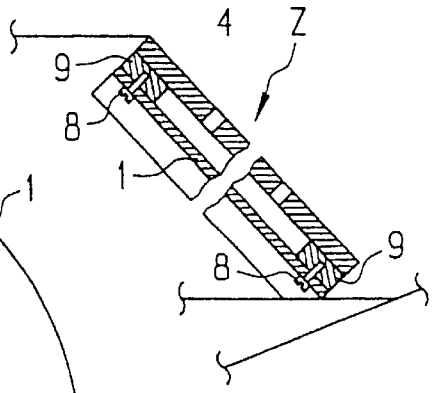
FIG 1b
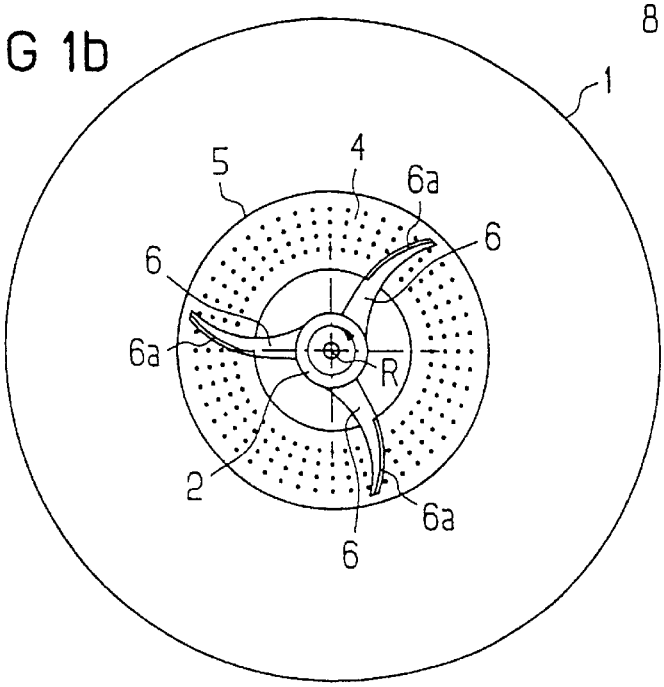

PULPER

CROSS-REFERENCE TO RELATED APPLICATIONS

The present application is a U.S. national phase application of PCT International Application No. PCT/EP99/03852, having an international filing date of Jun. 2, 1999; the International Application was published in the English language under PCT Article 21(2) and claims priority to German Application No. 198 24 806.7 filed Jun. 3, 1998.

FIELD OF THE INVENTION

The present invention relates to a screening device according to the preamble of claim 1, as is known from DE 964 286 C.

BACKGROUND OF THE INVENTION

Such pulper devices are disclosed in DE-AS 23 48 540 and in DE-AS 26 58 845 as well as in DE 20 61 519 C2 and in U.S. Pat. No. 2,661,666. Another pulper device is disclosed in FR-A-1 374 767.

Screening devices are used in most various industrial branches for the most different cases of application. Screening devices are widely used in processing technologies for sorting free-flowing substances, which contain solid materials of different sizes. An important case of application relates to the so-called pulper, which is used for processing material mixtures containing easy to pulp components. Important cases of application relate to the processing of wastes and waste-like materials as well as to paper industry for the processing of waste paper.

Such a pulper comprises a vessel provided with a rotor. During operation the material mixture to be processed is charged into the vessel, and a liquid, in general water, is moreover filled into the vessel. The rotor is rotated thereby generating strong flow forces. Seen in an axial section through the pulper, said flow has a toroidal form, whereby two main flow components overlap each other, namely a radial and a concentric flow direction. In the region of the rotor said flow at first flows outwardly against the wall of the vessel in a radial manner and then rises upwardly, so as to flow again radially towards the inside in the region of the surface of the liquid, whereupon it is conducted to the center of the rotor. Said flow can be supported by mounting additional guiding plates. At the same time, the liquid is subjected to a motional impulse in the rotational direction of the rotor. Said toroidal flow causes the solid matter contained in the liquid to repeatedly reach the region of the rotor, where it is processed.

Due to the strong flow the easily pulpable solid materials contained in the pulper are pulped. Apart from the pulping, partly also a shortening of fibers takes place or, respectively, part of the pulpable materials is dissolved. As the main emphasis of the process, however, lies in the pulping, merely the "pulping" will be discussed in this respect, while the disintegration and the dissolution taking place parallel to it will not be dealt with separately.

The pulped components of the charged material mixture form a suspension together with the liquid, which can be drawn off from the pulper by means of a punched screen. The non-pulped components remaining in the pulper (hereinafter also called "coarse materials") can be removed from the pulper in a different manner, e.g. by means of a coarse dirt collector projecting into the pulper.

A preferred case of application, for instance, relates to the processing of waste paper or the processing of wastes for a biological utilization of individual components. During the processing of wastes the components, which under a biological aspect are favorable for utilization, are separated from those components, which cannot biologically be utilized, as the biologically utilizable components can be pulped easily whereas it is difficult or impossible to pulp the other components.

The formed suspension separated by the punched screen, in which the biologically utilizable components are concentrated, can then be subjected to the biological processing, whereas the biologically non-utilizable components, i.e. the coarse materials remaining in the pulper after the suspension has been drawn off, are separated and can be supplied to another appropriate form of utilization, or they may be removed.

Other screening devices so far used in connection with pulpers for separating coarse materials from the suspension are either formed as flat screens (such as in EP 0 520 172 B1 or DE 195 06 084 A1) or as cylindrical screens (such as in EP 0 598 187 B1).

The use of a flat screen results in that the toroidal flow is diverted on the screen entailing the disadvantage that the solid materials in the pulper, which cannot or only with difficulties be pulped, such as pebbles, broken glass or the like, thereby cause a high wear of the screen. Moreover, there is the risk that the screen holes are clogged. Heavy components in the material mixture tend to sink onto the screen, where they remain unless they are pulped, so that they cannot pass the screen together with the suspension. A common method for keeping the screen free from such coarse materials and for guaranteeing the passage of the suspension is to repeatedly clean the surface of the screen by means of clearance rails. Said clearance rails, however, are also subject to a high wear.

The use of a cylindrical vertical screen entails other disadvantages. The suspension is here drawn off through the vertically situated screen elements. The non-pulped coarse materials in this case tend to accumulate around the screen on the bottom of the pulper thereby clogging the passageway through the screen. The flow conditions in the pulper are not suited to effect a satisfactory progression of the coarse materials and thereby a cleaning of the surface of the screen, since the flow does not touch the vertical elements of the screen. Here, too, the screen can only be cleaned by additional methods, in general by using clearance rails. The coarse materials accumulating around the screen on the bottom of the pulper likewise contribute to a high wear. The use of clearance rails, moreover, results in another essential disadvantage, as the clearance rails strongly disintegrate the plastic components present in the waste. Said small plastic particles can thereby pass the punched screen together with the suspension. In this way they contaminate the suspension destined for a biological utilization, which also results in an undesired contamination level of the finished products, above all of the compost and the process water.

SUMMARY OF THE INVENTION

It is the object of the present invention to improve the above-defined pulper device for separating coarse materials from a suspension so as to reduce wear, to facilitate the cleaning and maintenance of the screen, to accelerate the passage of the suspension and to improve the product quality.

According to the invention said object is provided by the pulper described in patent claim 1. The subclaims describe additional preferred embodiments of the invention.

The gist underlying the present invention resides in that a screening device is used, which has the shape of a truncated cone. The truncated cone points upwardly with the smaller circular surface thereof. The holes of the screening device are provided on the inclined lateral surface of the truncated cone. The inclination is configured such that it lies in an approximately tangential or, respectively, parallel manner to the toroidal flow. Moreover, the screening device is segmented and can be mounted externally.

The angle or inclination amounts to preferably 30°–50°, whereby said value can vary in response to the shape of the vessel. The inclined arrangement results in that the flow constantly causes the coarse materials sinking down in the pulper to be removed from the lateral surface of the screen, i.e. they are entrained by the flow. Said process is even supported by the use of scrapers, which are, however, subject to a smaller load in comparison to those according to the prior art, as the cleaning is not exclusively effected by clearance rails—in contrast to the described flat screens or cylindrical screens—but to a considerable extent by the flow.

As the coarse materials are constantly moved away from the screen with the flow so that, in contrast to the screening device used according to the prior art, they can accumulate on the screen or around the screen to a much smaller extent, also the abrasion caused by sand, pebbles, glass etc. is essentially reduced. Due to the better cleaning of the surface of the screen, moreover, the passage through the screen is rendered more favorable, whereby the draw-off time of the suspension is reduced.

The holes in the screen may be shaped differently, they may have, for instance, square, circular or oblong shapes. Their characteristic dimensions preferably are 6–30 mm. The screen is preferably sub-divided into segments so as to facilitate the disassembly thereof.

The scrapers used for supporting the cleaning of the screen holes from coarse dirt are preferably mounted on the rotor or the shaft thereof and may likewise have different shapes. They may, for example, be straight or inclined. The scrapers are preferably continuously or discontinuously curved opposite to the flow, and are provided with a wear shield. The wear shield can preferably be exchanged and/or adjusted.

For drawing off the suspension from the pulper through the screen a pump is preferably applied, the drive of which can be controlled. However, also an unobstructed discharge into a lower-lying storing vessel is possible.

The invention is especially suited for the use in processing and separating waste mixtures with a high organic portion, e.g. of communal biological wastes. Apart from biogenous organic components, which are suited for a biological treatment and subsequent recycling into the natural circulation, said wastes are characterized by a relevant portion of non-biogenous organic interference materials, such as plastics, pebbles, glass and metals.

The present invention will hereinafter be explained in more detail by means of a preferred embodiment with reference to the accompanying drawing.

BRIEF DESCRIPTION OF THE DRAWINGS

FIGS. 1*a* to 1*c* show a schematic illustration of an embodiment of the screening device according to the invention, wherein FIG. 1*a* shows a cross-section, FIG. 1*b* shows a section along line A–A' of FIG. 1*a* and FIG. 1*c* shows an enlarged section of the area designated by Z.

The waste mixture is fed to the cylindrical pulper vessel 1 with the addition of water. I designates the waste supply and II the water supply.

DETAILED DESCRIPTION OF THE PREFERRED EMBODIMENTS

By rotations of the rotor 2 about the axis R of the vessel the waste-water mixture is started to move. A strong toroidal flow 3 is generated resulting in the pulping of the biogenous organic non-lignified components of the waste. Said fibers form a suspension together with the liquid present in the pulper, which is drawn off through the truncated punched screen 4 located in the lower part of the pulper and flows out through the outflow III, to which a pump (not shown) may be connected, if required. The non-biogenous organic and the lignified components of the waste remain in the pulper vessel 1, which remain largely undestroyed by the flow forces, i.e. the coarse materials.

The formed suspension separated by the punched screen, in which the biologically utilizable components are concentrated, can then be subjected to the biological processing, while the biologically non-utilizable components, i.e. the coarse materials remaining in the pulper after the suspension has been drawn off, can be subjected to another appropriate form of processing or another form of removal.

The herein described embodiment of the inventive screening device 4 has the shape of a truncated cone. The holes of the screen are provided on the lateral surface 5 of the truncated cone, they are round and have a diameter of typically 10 mm. The angle of the external surface of the screen is about 30° to 50° relative to the rotational axis R.

As can particularly be seen in FIG. 1*b*, scrapers 6 are fastened to the rotor 2 or the rotor shaft, respectively, which are curved in an arc-shaped manner opposite to the flow. The front face of the scrapers 6 is protected by an exchangeable and adjustable wear shield 6*a*. A collecting container (not shown) is provided underneath outflow III, in which the discharged suspension is collected.

As can be seen in FIG. 1*c*, the screen segments of screen 4 are attached from the external side of the vessel with screws 8 to webs 9 such that they can be detached from the internal side of the vessel when the screws 8 are removed.

Although the present invention was described above on the basis of a preferred embodiment, it is not restricted thereto, but may be modified in various ways and manners.

What is claimed is:

1. A pulper for defibration of a liquid solid mixture suspension, said pulper comprising:

a) a vertically oriented vessel defining a chamber, the vessel having a lower portion, an internal side adjacent the chamber and an external side opposite the chamber;

b) means for pulping and generating a toroidal flow of the suspension in the chamber;

c) a truncated cone-shaped screening device to separate coarse materials from the suspension, the screening device being subdivided into a plurality of segments mounted on the internal side of the vessel adjacent the lower portion of the vessel, the screening device having a lateral surface disposed approximately tangential to the toroidal flow and a plurality of holes in the lateral surface;

d) a plurality of webs located adjacent the lower portion of the vessel between the vessel and the plurality of segments, wherein the plurality of segments are individually fixed on the webs; and e) a plurality of screws inserted into the lower portion of the vessel and engaging the webs, wherein the screws are accessible from the external side of the vessel;

f) wherein the plurality of segments are individually detachable from the internal side of the vessel upon removal of the screws from the external side of the vessel.

2. The pulper according to claim 1, wherein the angle of the lateral surface is between 30° and 50° with respect to vertical.

3. The pulper according to claim 1, wherein the screen holes have a square, circular or oblong shape.

4. The pulper according to claim 1, wherein the holes of the screening device are circular and have a diameter of 6–30 mm.

5. The pulper according to claim 1, wherein the holes of the screening device are circular and have a diameter of 8–12 mm.

6. The pulper according to claim 1, wherein:

the means for pulping and generating a toroidal flow includes a rotor device in the vessel;

the rotor device defines a rotor axis;

the truncated cone shaped screening device defines a screening device axis; and the screening device axis is substantially aligned with the rotor axis.

7. The pulper according to claim 1, wherein the means for pulping and generating a toroidal flow further includes:

a rotor device; and a scraping device rotatably connected to the rotor device, wherein the scraping device is adapted to clean the screening device.

8. The pulper according to claim 7, wherein the scraping device comprises at least one scraper having a curvature opposite to the flow.

9. The pulper according to claim 1, further including a pump and a controllable drive operative to draw the suspension off through the screening device.

10. A pulper for defibration of a liquid solid mixture suspension, said pulper comprising:

a) a vessel defining a chamber, the vessel having a lower portion, an internal side adjacent the chamber and an external side opposite the chamber;

b) means for pulping and generating a toroidal flow of the suspension in the chamber;

c) a truncated cone-shaped screening device to separate coarse materials from the suspension, the screening device being subdivided into a plurality of segments individually mounted from the external side of the vessel adjacent the lower portion of the vessel, the screening device having a lateral surface disposed approximately tangential to the toroidal flow and a plurality of holes in the lateral surface; and d) at least one scraper with an exchangeable and/or adjustable wear shield on a face thereof facing the screening device.

11. The pulper according to claim 1, wherein the screening device is vertically oriented such that a smaller end of the screening device is positioned above a larger end of the screening device.

* * * * *